US008123556B2

(12) United States Patent
Esplin et al.

(10) Patent No.: US 8,123,556 B2
(45) Date of Patent: Feb. 28, 2012

(54) LOW PROFILE COMPACT RF COAXIAL TO PLANAR TRANSMISSION LINE INTERFACE

(75) Inventors: Roger C. Esplin, Marana, AZ (US); John M. Oldham, Marana, AZ (US)

(73) Assignee: Raytheon Company, Waltham, MA (US)

( * ) Notice: Subject to any disclaimer, the term of this patent is extended or adjusted under 35 U.S.C. 154(b) by 372 days.

(21) Appl. No.: 12/421,315

(22) Filed: Apr. 9, 2009

(65) Prior Publication Data

US 2011/0183544 A1 Jul. 28, 2011

(51) Int. Cl.
*H01R 17/18* (2006.01)

(52) U.S. Cl. ..... 439/579; 439/581; 439/63

(58) Field of Classification Search ..... 439/579, 439/63, 581

See application file for complete search history.

(56) References Cited

U.S. PATENT DOCUMENTS

| | | | | |
|---|---|---|---|---|
| 3,676,573 | A | 7/1972 | Avery | |
| 4,897,046 | A | 1/1990 | Tengler et al. | |
| 5,046,966 | A | 9/1991 | Snyder et al. | |
| 6,808,395 | B2 | 10/2004 | Lin et al. | |
| 7,056,148 | B2 | 6/2006 | Staniszewski et al. | |
| 7,118,382 | B2 * | 10/2006 | Kerekes et al. | 439/63 |
| 7,210,941 | B2 * | 5/2007 | Rosenberger | 439/63 |
| 7,344,381 | B2 | 3/2008 | Kerekes | |
| 7,357,641 | B2 * | 4/2008 | Kerekes et al. | 439/63 |
| 7,708,592 | B2 * | 5/2010 | Schnare | 439/581 |
| 2010/0124827 | A1 * | 5/2010 | Blair et al. | 439/63 |
| 2010/0173522 | A1 * | 7/2010 | Schnare | 439/581 |

FOREIGN PATENT DOCUMENTS

WO WO-2010117421 A1 10/2010

OTHER PUBLICATIONS

"International Application Serial No. PCT/US2010/000951, Search Report mailed Jun. 4, 2010", 4 pgs.
"International Application Serial No. PCT/US2010/000951, Written Opinion mailed Jun. 4, 2010", 8 pgs.

* cited by examiner

*Primary Examiner* — Gary F. Paumen
(74) *Attorney, Agent, or Firm* — Schwegman, Lundberg & Woessner, P.A.

(57) ABSTRACT

A compact, low profile coaxial to printed wiring board interface includes an interface block and an adapter. The interface block has a stepped opening for receiving the adapter and a coaxial cable. The adapter includes an outer profile with a series of steps that align and mate with the stepped opening of the interface block. An inner insulator of the coaxial cable is positioned entirely within the interface block and lies substantially flush with a first outside surface of the interface block, an outer conductor of the coaxial cable is positioned at an approximate midpoint interface of the adapter, an outer insulator of the coaxial cable lies flush with an external surface of the adapter, and a portion of the adapter positioned outside the interface block comprises a low profile such that the coaxial cable can be positioned away from a perpendicular to the interface block.

14 Claims, 5 Drawing Sheets

LOW PROFILE COMPACT RF COAXIAL TO PLANAR TRANSMISSION LINE INTERFACE

STATEMENT OF GOVERNMENT INTEREST

This invention was made with United States Government support under Contract number N00024-02-05421 with the Department of the Navy. The United States Government has certain rights in this invention.

TECHNICAL FIELD

The present invention relates to RF coaxial to planar transmission line interfaces, and in an embodiment, but not by way of limitation, to a low profile compact RF coaxial to planar transmission line interface.

BACKGROUND

A typical commercial off the shelf (COTS) interface that is used to connect a coaxial cable to a printed wiring board is illustrated in FIG. 1. The COTS interface 100 includes a board mount jack 105 that couples to the printed wiring board 107. The jack 105 includes a center conductor 110, which serves as an electrical coupling agent to the printed wiring board. A transition piece 115 includes a center conductor transition piece 120, which inserts into the center conductor 110. The transition piece 115 includes another center conductor transition piece 125, which includes a female portion to receive the center conductor 155 of a coaxial cable 130. The interface 100 further includes a plug 135 that encases the two coupled coaxial connections in the interface 100. The coaxial cable includes an outer insulator 140, an outer conductor 145, and an inner insulator 150, all of which terminate at the outer housing portion of the interface 100.

DETAILED DESCRIPTION

Figure 1:
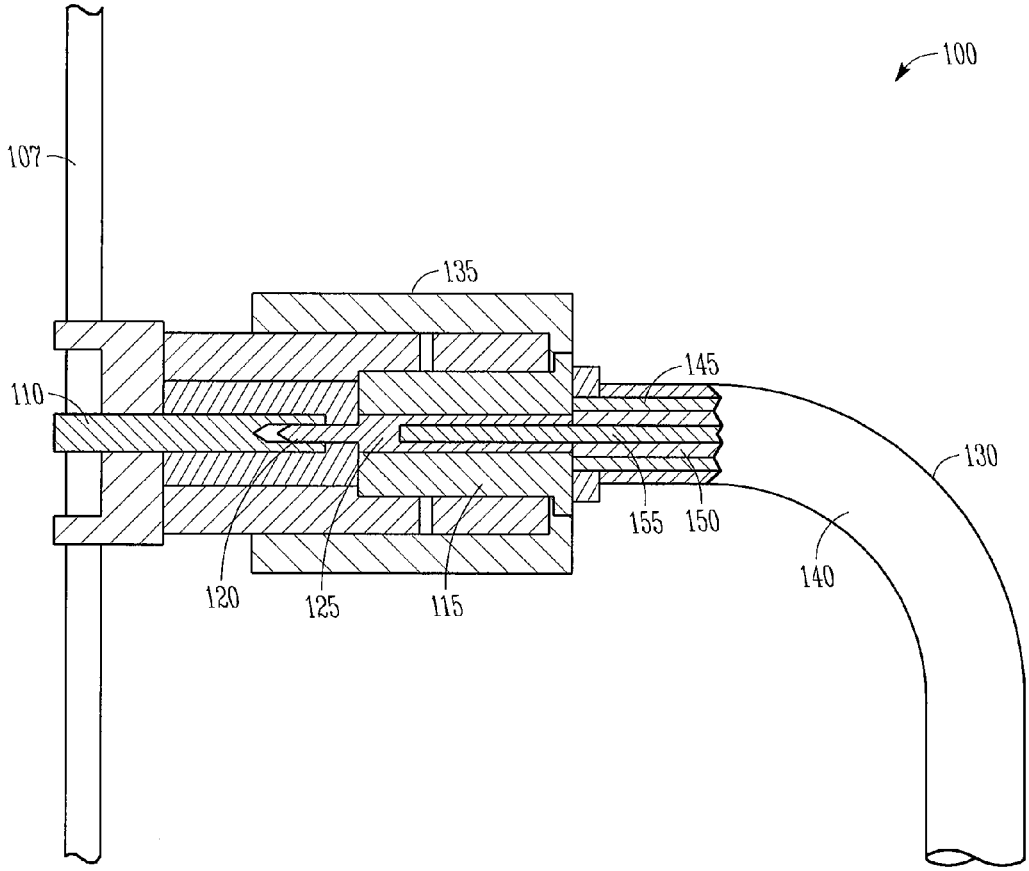
FIG. 1 (PRIOR ART)
FIG. 1 illustrates a cross sectional view of a commercial off the shelf coaxial line interface.
Figure 2:
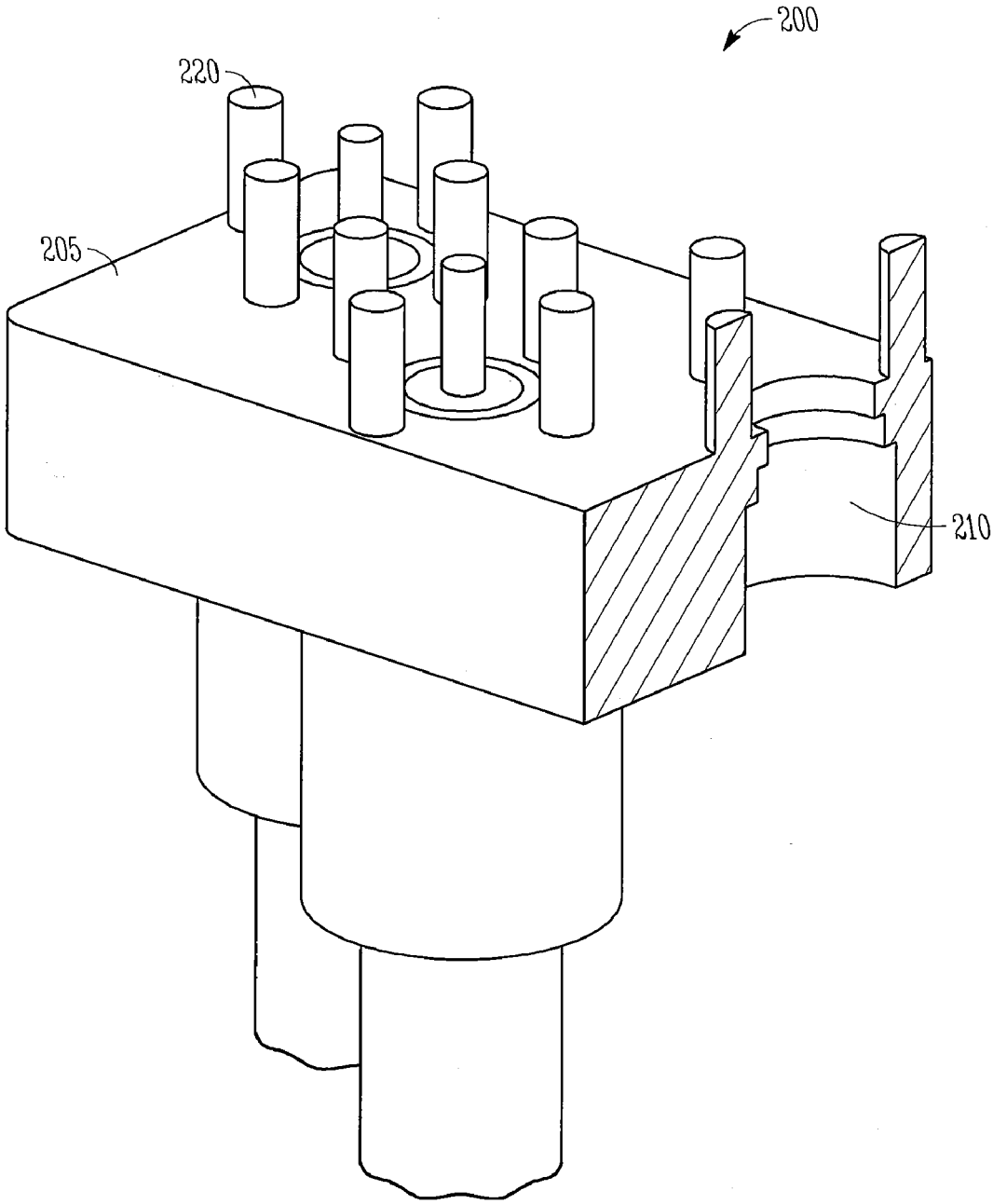
FIG. 2 illustrates a cross sectional view of a low profile RF coaxial to planar transmission line interface.

In the following detailed description, reference is made to the accompanying drawings that show, by way of illustration, specific embodiments in which the invention may be practiced. These embodiments are described in sufficient detail to enable those skilled in the art to practice the invention. It is to be understood that the various embodiments of the invention, although different, are not necessarily mutually exclusive. For example, a particular feature, structure, or characteristic described herein in connection with one embodiment may be implemented within other embodiments without departing from the scope of the invention. In addition, it is to be understood that the location or arrangement of individual elements within each disclosed embodiment may be modified without departing from the scope of the invention. The following detailed description is, therefore, not to be taken in a limiting sense, and the scope of the present invention is defined only by the appended claims, appropriately interpreted, along with the full range of equivalents to which the claims are entitled. In the drawings, like numerals refer to the same or similar functionality throughout the several views.

FIGS. 2, 3, 4, and 5 illustrate in cross sectional view a low profile compact coaxial to planar transmission line interface 200. The interface 200 is used to couple a coaxial cable to a printed wiring board. The interface 200 includes an interface block 205. The interface block 205 includes a stepped opening 210. The interface block 205 may include more than one stepped opening 210. In the embodiments of FIGS. 2-5, the stepped opening has three steps 215A, 215B, and 215C therein. A different number of steps could also be used in the stepped opening 210. The interface block further includes a means to attach to a printed wiring board. In an embodiment, the means includes one or more grounding pins 220.

Figure 3:
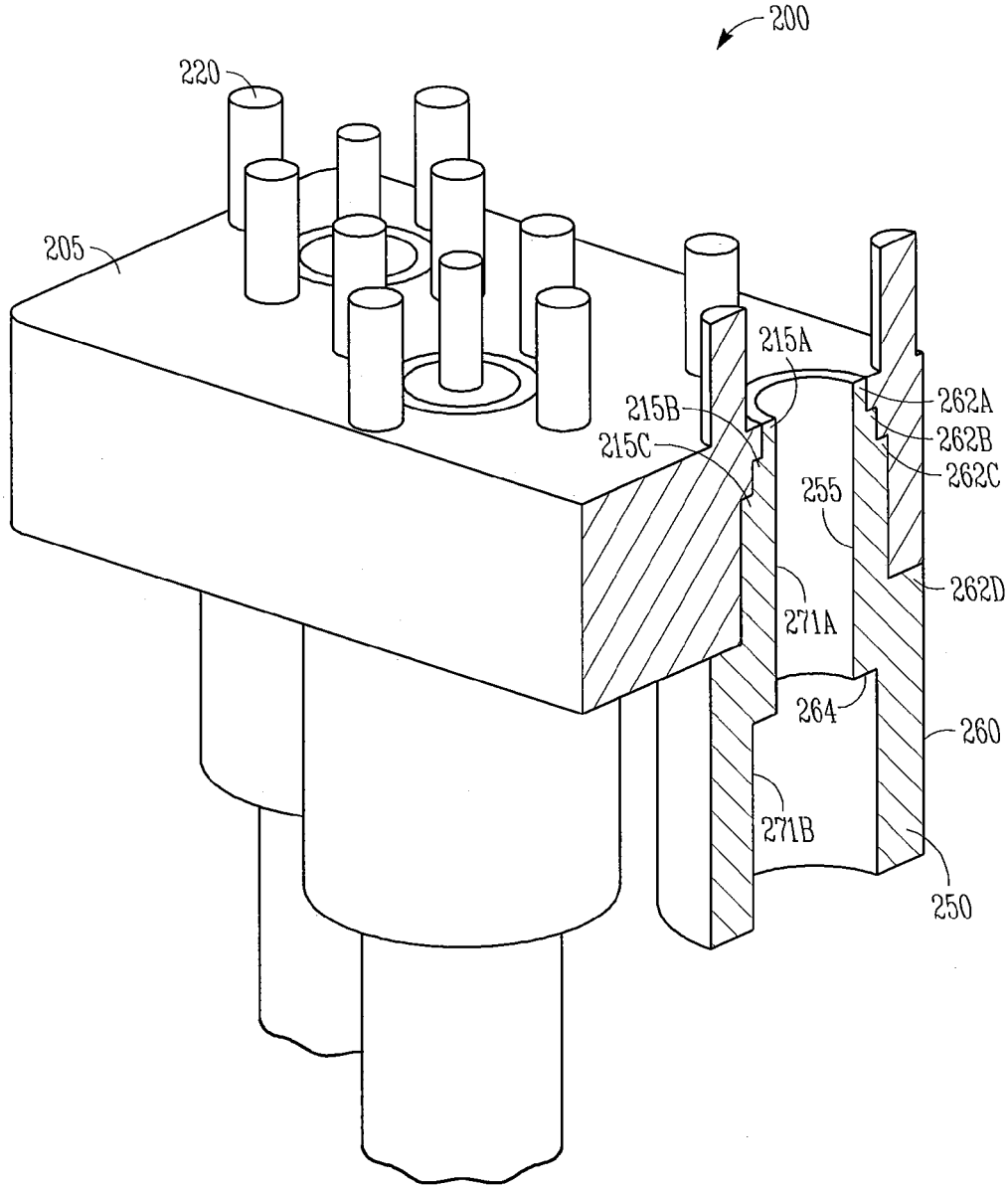
FIG. 3 illustrates another cross sectional view of a low profile compact RF coaxial to planar transmission line interface.

FIG. 3 illustrates a cross sectional view of the interface 200 with an adapter 250 inserted into the interface block 205. The adapter 250 includes an inner profile 255 and an outer profile 260. The outer profile 260 includes a series of one or more steps. In the embodiment of FIG. 3, the outer profile of the adapter includes a series of four steps 262A, 262B, 262C, and 262D. While four steps are illustrated for the outside profile of the adapter in FIG. 3, other embodiments can include a different number of steps. The steps 262A, 262B, 262C, and 262D align and mate with the steps 215A, 215B, and 215C of the stepped opening 210. In the embodiment of FIG. 3, the step 262D rests on the outside surface of the interface block 205. Further in the embodiment of FIG. 3, the step 262D is an outermost step of the outer profile 260 of the adapter 250. The inner profile of the adapter 250 includes a first inner diameter 271A and a second inner diameter 271B, thereby forming a step 264. The intersection of the first diameter 271A and the second diameter 271B forms the step 264 at the approximate midpoint of the adapter 250.

Figure 4:
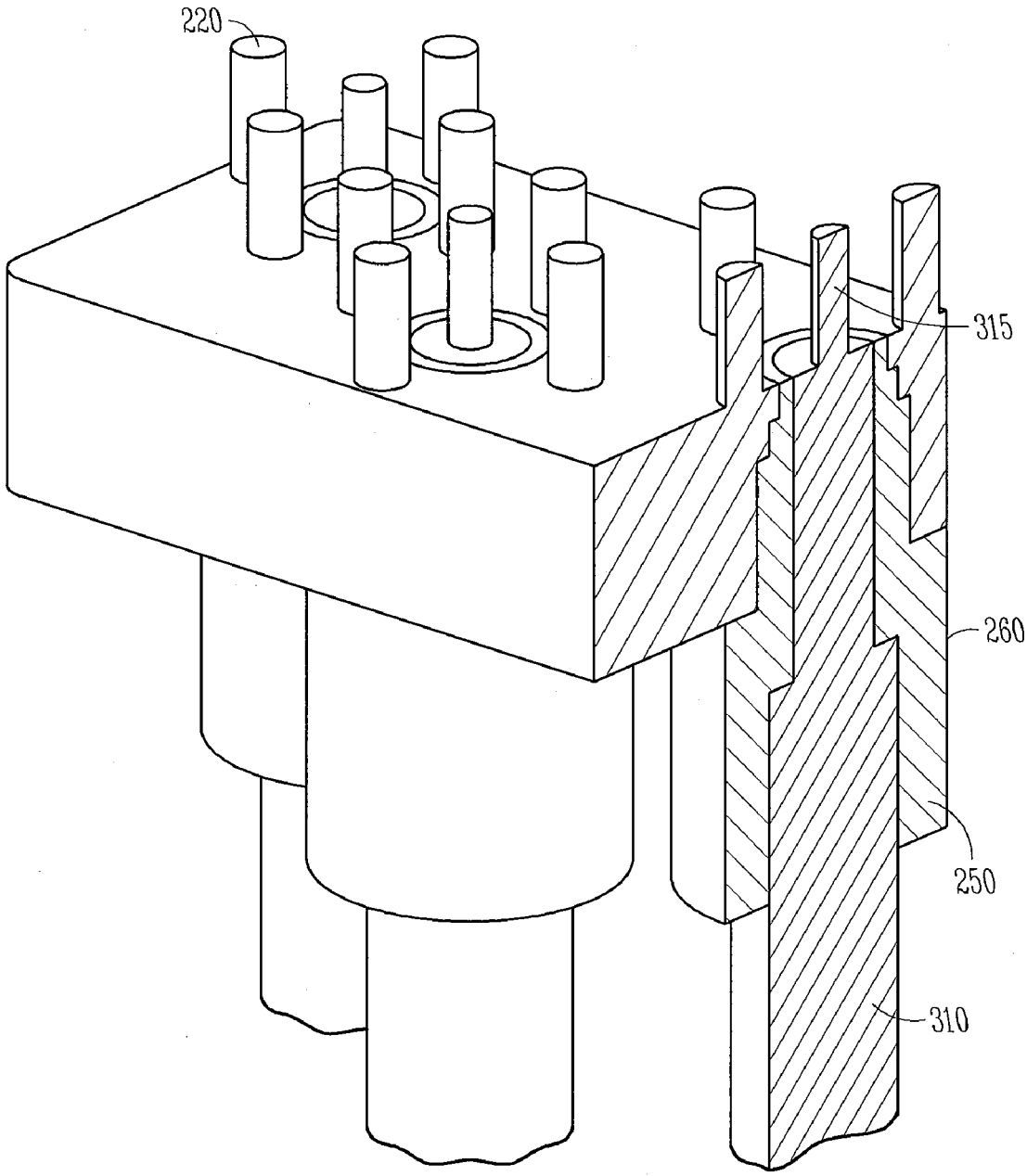
FIG. 4 illustrates a cross sectional view of a low profile compact RF coaxial to planar transmission line interface with a coaxial cable inserted into the interface.
Figure 5:
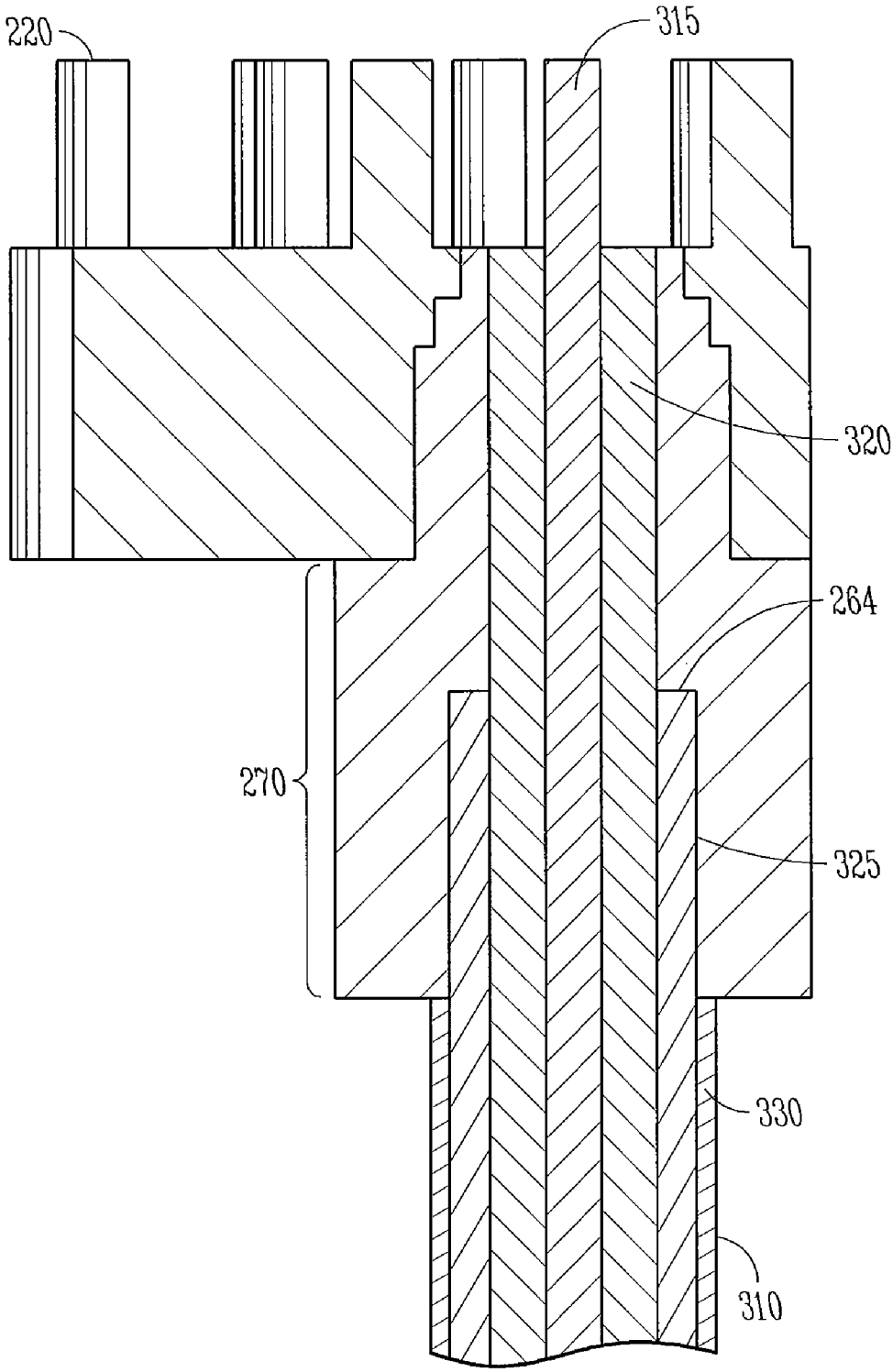
FIG. 5 illustrates another cross sectional view of a low profile compact RF coaxial to planar transmission line interface with a coaxial cable inserted into the interface.

FIGS. 4 and 5 illustrate a cross section of a coaxial cable 310 that is inserted in the interface block and adapter construct. The coaxial cable 310 is inserted into the adapter 250, which is or has been inserted into the stepped opening 210 of the interface block 205. In this manner, the stepped opening 210 and the adapter 250 provide a passageway for the coaxial cable 210 to connect to a printed wiring board (not shown in FIGS. 2-5). Specifically, the passageway provided by the stepped opening 210 of the interface block 205 receives a center conductor 315 of a coaxial cable 310 that is inserted through the interface block 205 to the printed wiring board side of the interface block. In this manner, the center conductor 310 is inserted into and coupled to the printed wiring board.

The coax cable 310 includes an inner insulator 320. The inner insulator 320, when the coax cable 310 is inserted through the interface block 205 and into the printed wiring board, is positioned entirely within the interface block 205 and lies substantially flush with the outside surface of the interface block that faces the printed wiring board. The coaxial cable 310 further includes an outer conductor 325. The outer conductor 325, when the coaxial cable is inserted into the passageway of the interface block 205 and the adapter 250, comes to rest on the step 264 formed by the first inner diameter and the second inner diameter of the adapter. The coaxial cable 310 further includes an outer insulator 330, which when the coaxial cable 310 is inserted into the interface block and adapter interface, rests on the outside surface of the adapter 250.

The portion 270 of the adapter 250 that protrudes from the interface block 205 comprises a low profile. The low profile permits a coaxial cable 310 that is inserted into the interface block and adapter unit to be positioned away from a perpendicular to the interface block (or a line parallel to the central axis of the stepped opening of the interface block and the central axis of the adapter). In an embodiment, this low profile results in a distance, between the printed wiring board and the point of an attached coaxial cable that is bent to parallel in relation to the printed wiring board, of approximately 0.400 inches. Because of this low profile of the interface block and adapter construct, the positioning away from the perpendicular can be obtained closer to the printed wiring board than the constructs of the prior art such as that illustrated in FIG. 1.

In the foregoing detailed description of embodiments of the invention, various features are grouped together in one or more embodiments for the purpose of streamlining the disclosure. This method of disclosure is not to be interpreted as reflecting an intention that the claimed embodiments of the invention require more features than are expressly recited in each claim. Rather, as the following claims reflect, inventive subject matter lies in less than all features of a single disclosed embodiment. Thus the following claims are hereby incorporated into the detailed description of embodiments of the invention, with each claim standing on its own as a separate embodiment. It is understood that the above description is intended to be illustrative, and not restrictive. It is intended to cover all alternatives, modifications and equivalents as may be included within the scope of the invention as defined in the appended claims. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein," respectively. Moreover, the terms "first," "second," and "third," etc., are used merely as labels, and are not intended to impose numerical requirements on their objects.

The abstract is provided to comply with 37 C.F.R.1.72(b) to allow a reader to quickly ascertain the nature and gist of the technical disclosure. The Abstract is submitted with the understanding that it will not be used to interpret or limit the scope or meaning of the claims.

The invention claimed is:

1. A compact, low profile coaxial to printed wiring board interface comprising:

an interface block comprising:

an opening therein, the opening providing a passageway to a connection on the printed wiring board; and an adapter comprising:

an inner profile and an outer profile, the outer profile configured to align and mate with the opening of the interface block;

wherein a portion of the adapter positioned outside the interface block comprises a low profile such that the coaxial cable can be positioned away from a perpendicular to the interface block.

2. The interface of claim 1, wherein the interface block opening comprises a stepped opening, and wherein the adapter outer profile comprises a series of steps configured to align and mate with the stepped opening of the interface block, and the inner profile of the adapter comprises a first inner diameter and a second inner diameter;

the adapter and the passageway of the interface block receive a center conductor of a coaxial cable inserted through the adapter and the interface block, and wherein the center conductor is coupled to the printed wiring board;

an inner insulator of the coaxial cable is positioned entirely within the interface block and lies substantially flush with a first outside surface of the interface block;

an outer conductor of the coaxial cable is positioned at the interface of the first inner diameter and second inner diameter of the adapter; and an outer insulator of the coaxial cable lies flush with a first external surface of the adapter.

3. The interface of claim 1, wherein the interface block comprises a means to attach to the printed wiring board.

4. The interface of claim 3, wherein the means to attach the interface block to the printed wiring board comprises one or more grounding pins.

5. The interface of claim 2, wherein a step of the outer profile of the adapter rests on a second outside surface of the interface block.

6. The interface of claim 2, wherein an intersection of the first inner diameter and the second inner diameter forms a step at an approximate midpoint of the adapter.

7. The interface of claim 2, wherein the interface block comprises a plurality of stepped openings to accommodate a plurality of coaxial cables.

8. The interface of claim 2, wherein the step of the outer profile of the adapter that rests on the first outside surface of the interface block comprises an outermost step of the outer profile of the adapter.

9. The interface of claim 2, wherein the stepped opening of the interface block comprises three steps.

10. A compact, low profile coaxial to printed wiring board interface comprising:

an interface block comprising:

a stepped opening therein, the stepped opening providing a passageway to a connection on the printed wiring board, and the interface block comprising a means to attach to the printed wiring board; and an adapter comprising:

an inner profile and an outer profile, the outer profile comprising a series of steps configured to align and mate with the stepped opening of the interface block, wherein a step of the outer profile rests on a first outside surface of the interface block, and the inner profile of the adapter comprising a first inner diameter and a second inner diameter, wherein an intersection of the first inner diameter and the second inner diameter forms a step at an approximate midpoint of the adapter;

wherein the adapter and the passageway of the interface block receive a center conductor of a coaxial cable inserted through the adapter and the interface block, and wherein the center conductor is coupled to the printed wiring board;

wherein an inner insulator of the coaxial cable is positioned entirely within the interface block and lies substantially flush with a second outside surface of the interface block;

wherein an outer conductor of the coaxial cable is positioned at the interface of the first inner diameter and second inner diameter of the adapter;

wherein an outer insulator of the coaxial cable lies flush with a first external surface of the adapter; and wherein a portion of the adapter positioned outside the interface block comprises a low profile such that the coaxial cable can be positioned away from a perpendicular to the interface block.

11. The interface of claim 10, wherein the means to attach the interface block to the printed wiring board comprises one or more grounding pins.

12. The interface of claim 10, wherein the interface block comprises a plurality of stepped openings to accommodate a plurality of coaxial cables.

13. The interface of claim 10, wherein the step of the outer profile of the adapter that rests on the first outside surface of the interface block comprises an outermost step of the outer profile of the adapter.

14. The interface of claim 10, wherein the stepped opening of the interface block comprises three steps.

* * * * *